US009374862B2

(12) United States Patent
Huang et al.

(10) Patent No.: US 9,374,862 B2
(45) Date of Patent: Jun. 21, 2016

(54) CIRCUIT FOR VEHICLE LAMPS

(71) Applicant: Chih-Yuan Huang, Kaohsiung (TW)

(72) Inventors: Chih-Yuan Huang, Kaohsiung (TW); Chang-Chih Lin, Kaohsiung (TW); Shu-Fen Huang, Kaohsiung (TW)

(73) Assignee: Chih-Yuan Huang, Kaohsiung (TW)

( * ) Notice: Subject to any disclaimer, the term of this patent is extended or adjusted under 35 U.S.C. 154(b) by 544 days.

(21) Appl. No.: 13/675,173

(22) Filed: Nov. 13, 2012

(65) Prior Publication Data

US 2014/0132166 A1 May 15, 2014

(51) Int. Cl.
*H05B 33/08* (2006.01)

(52) U.S. Cl.
CPC ..... *H05B 33/0821* (2013.01)

(58) Field of Classification Search
CPC . H05B 33/0821; H05B 33/0881; Y02B 20/48
See application file for complete search history.

(56) References Cited

U.S. PATENT DOCUMENTS 4,356,481 A * 10/1982 Kuki ..... G01R 19/16542 340/636.15
6,262,494 B1 * 7/2001 Tsukuni ..... H02J 7/0047 307/80
6,275,042 B1 * 8/2001 Tsai ..... G01R 31/362 320/132
7,375,491 B2 * 5/2008 Lin ..... H02J 7/0073 320/107
2002/0050809 A1 * 5/2002 Uchida ..... H02J 1/04 320/149
2004/0042205 A1 * 3/2004 Tanabe ..... H05B 33/089 362/189
2009/0153059 A1 * 6/2009 Kitagawa ..... H05B 33/0881 315/77
2010/0109537 A1 * 5/2010 Nishino et al. ..... 315/185 R
2010/0295460 A1 * 11/2010 Lin et al. ..... 315/193
2010/0320483 A1 * 12/2010 Kadotani ..... F21K 9/00 257/88
2011/0062869 A1 * 3/2011 Hsu ..... B60Q 11/005 315/77

* cited by examiner

*Primary Examiner* — Jany Richardson
(74) *Attorney, Agent, or Firm* — Muncy, Geissler, Olds & Lowe, P.C.

(57) ABSTRACT

The present invention provides a circuit for driving a vehicle lamp, comprising a dummy load. Multiple unidirectional conduction electronic components are coupled to the dummy, operable for conducting a current path to enable a current to flow through the dummy load. Each of multiple LED strings is coupled to each of the multiple unidirectional conduction electronic components, respectively.

11 Claims, 3 Drawing Sheets

CIRCUIT FOR VEHICLE LAMPS

TECHNICAL FIELD

The present invention generally relates to a circuit for a vehicle lamp, more particularly, to a circuit with a common dummy load, for driving vehicle lamps.

BACKGROUND

In recent years, light sources such as light emitting diodes (LEDs) have been improved through technological advances in material and manufacturing processes. The LEDs possess characteristics such as a relatively high efficiency, a relatively long life, and vivid colors, and can be used in a variety of industries. One example is to use the LEDs to replace traditional incandescent bulbs in a vehicle lamp. Compared with traditional incandescent bulbs, the LEDs are lighter, compact, long-life, and energy-saving. Moreover, the response time of the LEDs is faster than that of the incandescent bulbs.

For some vehicles that are originally designed to be equipped with incandescent bulbs, there will be a problem if the incandescent bulbs are directly replaced by LEDs.

FIG. 1 illustrates a conventional circuit for using an incandescent bulb in a vehicle. The incandescent bulb 102 is powered by a power source 100, e.g., a battery, via a power line. Under certain circumstances, a vehicle may need to perform a self-testing to examine whether the incandescent bulb 102 is turned on properly. As the vehicle starts, a micro controlling unit (not shown in FIG. 1) in the vehicle may generate a testing signal (usually a square wave signal) and apply the testing signal to the power line. A detecting circuit (not shown in FIG. 1) monitors the voltage drop across the incandescent bulb 102. If a waveform of the testing signal has an amplitude greater than a predetermined level, the waveform can be detected by the detecting circuit. If the incandescent bulb 102 operates properly, the voltage drop (or current) across the incandescent bulb 102 is relatively small because the resistance of the filament in the incandescent bulb 102 is relatively small. That is, in operating properly, a constant current is created in the whole loop, and a current sensor 103 will sense the correct current value. Therefore, the waveform of the testing signal is not detected by the detecting circuit. If the incandescent bulb 102 is broken down, the current is relatively small or even causing an open circuit condition; then, the waveform of the testing signal can be detected by the detecting circuit across the incandescent bulb 102. If the testing signal is detected by the detecting circuit, the detecting circuit can determine that the incandescent bulb 102 is broken and remind the driver by turning on an indicator light on the dashboard. It is followed by maintaining or repairing the vehicle. Moreover, a switch 101 is connected in series to the incandescent bulb 102 for switching. The current sensor 103 is coupled to the incandescent bulb 102.

FIG. 2 illustrates a conventional circuit using LEDs to replace a traditional incandescent bulb in a vehicle. As shown in FIG. 2, a LED string 104 replaces the incandescent bulb. The LED string 104 includes multiple LEDs connected in series. Generally, the resistance of the LED string 104 is greater than the resistance of an incandescent bulb. Similarly, a switch 101 is connected in series to the LED string 104 for switching. The current sensor 103 is coupled to the LED string 104. As the incandescent bulb replaced by the LED string, the LED's power consumption is relatively small such that the loop current becomes small. If the current detected by a circuit system is lower than normal value, it will result in a warning to notify the driver.

FIG. 3 illustrates another conventional circuit for a vehicle lamp. In an example, the LED string 104 is connected to a dummy load 105 in parallel. As above-mentioned, the resistance of the LED string 104 is greater than that of an incandescent bulb. Therefore, when the micro controlling unit (not shown in FIG. 3) applies the testing signal on the power line, a waveform of the testing signal may be detected by the detecting circuit (not shown in FIG. 3) across the LED string 104, even if the LED string 104 operates properly. The micro controlling unit may render an erred judgment. To prevent a false alarm, a dummy load 105 is coupled to the LED string 104 in parallel. In order to generate an enough current, the both ends of the LED string 104 may be connected to a high-power electronic component as the dummy load 105 in parallel. In an example, the dummy load 105 is a resistor. The resistor 105 can have a relatively small resistance such that the total resistance of the parallel-connected dummy load 105 and the LED string 104 is even smaller. By properly choosing the resistance of the resistor 105, the testing signal is not detected by the detecting circuit across the LED string 104 such that the false alarm can be avoided. A drawback of this solution is that the resistor 105 will constantly consume power and generate heat if the vehicle lamp is turned on. Besides, a switch 101 is connected in series to the LED string 104 and the dummy load 105 for switching. The current sensor 103 is coupled to the LED string 104 and the dummy load 105. In one example, the current path includes a dummy load 101 and a switch 101 coupled in series.

FIG. 4 illustrates yet another conventional circuit for a vehicle lamp. Similarly, the LED string 121 is connected to a dummy load 131 in parallel. A switch 111 is connected in series to the combination of the LED string 121 and the dummy load 131 for switching. And, switches 112, 113 and 114 are connected in series to the combinations of LED strings 122, 123, 124 and dummy loads 131, 132, 133 for switching, respectively. In this example, the whole circuit includes four set combinations of the LED strings and the dummy loads. The current sensor 103 is coupled to the four set combinations of the LED strings and the dummy loads. A drawback of this solution is that the combinations of the LED strings and the dummy loads will constantly consume power and generate heat if the vehicle lamp is turned on. The complete set of the vehicle lamps may represent as four or five functions, and it needs to use the multiple combinations of the LEDs and the dummy loads such that the generating heat is a relatively large, and the volume becomes large. Besides, the current sensor 103 is coupled to the multiple combinations of the LED strings and the dummy loads.

Therefore, based-on the shortcomings of prior arts, the present invention provide a newly circuit for driving a vehicle lamp.

SUMMARY OF THE INVENTION

Based-on the shortcomings of the above-mentioned, an objective of the present invention is to provide a circuit for driving vehicle lamps by using a single dummy load, and thereby reducing the generating heat.

Another objective of the present invention is to provide a circuit for driving vehicle lamps, wherein multiple unidirectional conduction electronic components are coupled to the common dummy load, operable for conducting a current path to enable a current to flow through the common dummy load to decrease a total resistance.

According to an aspect of the present invention, it provides a circuit for driving a vehicle lamp, comprising a dummy load. Multiple unidirectional conduction electronic components are coupled to the dummy, operable for conducting a current path to enable a current to flow through the dummy load. Each of multiple LED strings is coupled to each of the multiple unidirectional conduction electronic components, respectively.

In another example, each of the multiple unidirectional conduction electronic components is a diode, such as rectifier diode.

The circuit further comprises a current sensor coupled to the dummy load, wherein one terminal of each of the multiple LED strings is coupled to the current sensor.

The circuit further comprises multiple switches, wherein each of the multiple switches is coupled to each of the multiple LED strings respectively, and coupled to one terminal of each of the multiple unidirectional conduction electronic components respectively.

BRIEF DESCRIPTION OF THE DRAWINGS

The components, characteristics and advantages of the present invention may be understood by the detailed descriptions of the preferred embodiments outlined in the specification and the drawings attached.

DETAILED DESCRIPTION

Some preferred embodiments of the present invention will now be described in greater detail. However, it should be recognized that the preferred embodiments of the present invention are provided for illustration rather than limiting the present invention. In addition, the present invention can be practiced in a wide range of other embodiments besides those explicitly described, and the scope of the present invention is not expressly limited except as specified in the accompanying claims.

Figure 1:
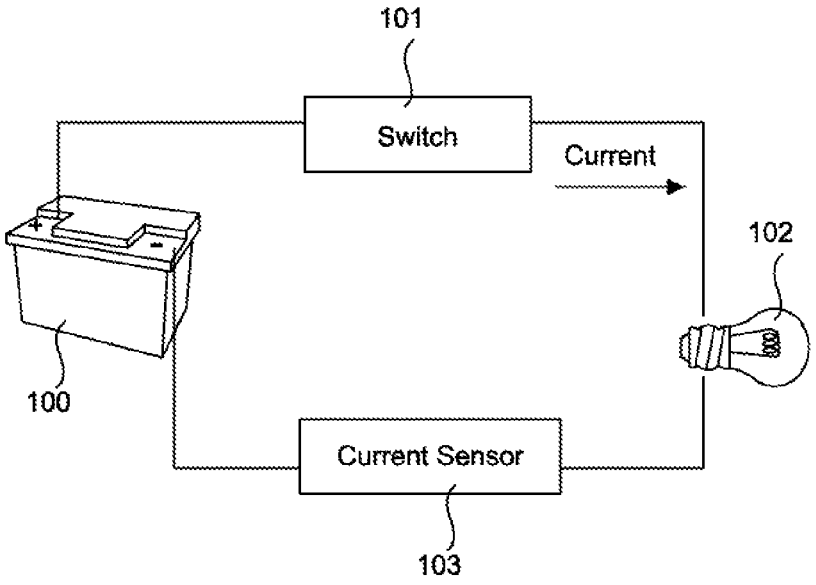
Fig.1 Prior Art
FIG. 1 illustrates a conventional circuit for using an incandescent bulb in a vehicle.
Figure 2:
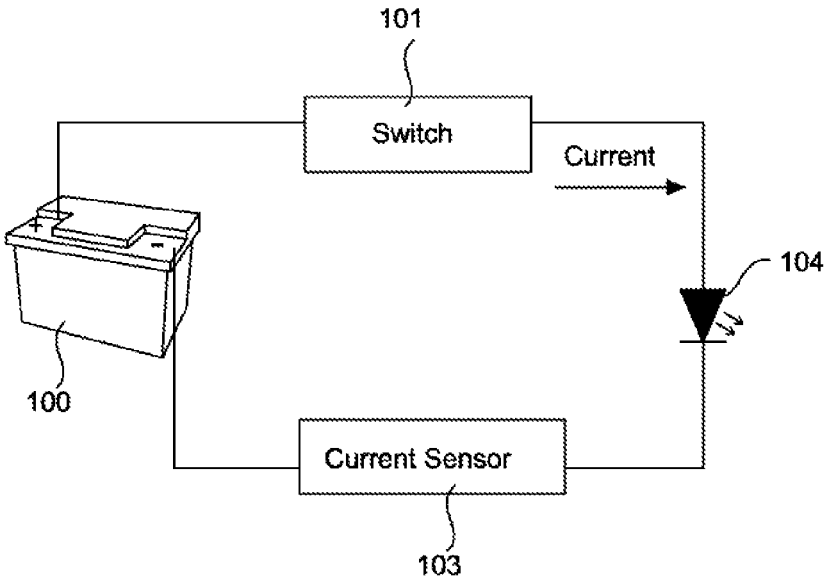
Fig.2 Prior Art
FIG. 2 illustrates a conventional circuit using LEDs to replace a traditional incandescent bulb in a vehicle.
Figure 3:
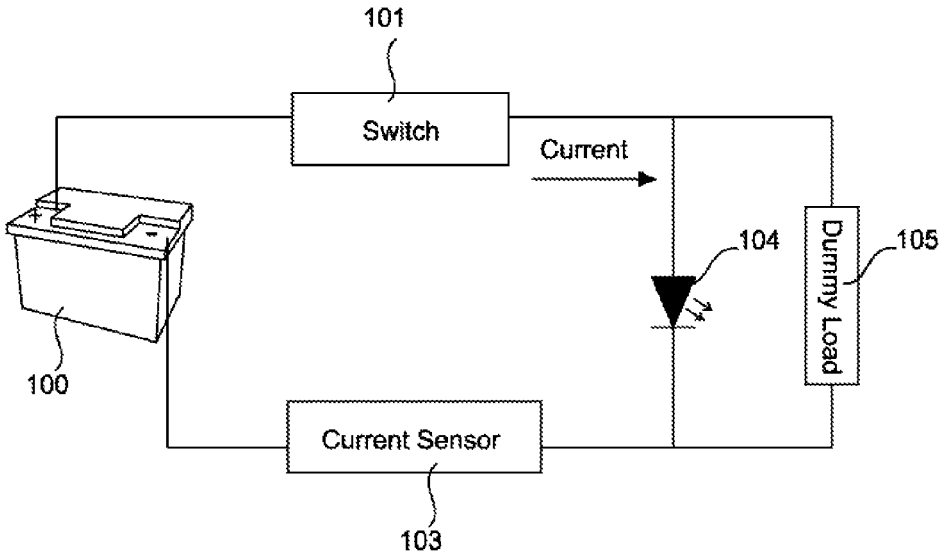
Fig.3 Prior Art
FIG. 3 illustrates another conventional circuit for a vehicle lamp.
Figure 4:
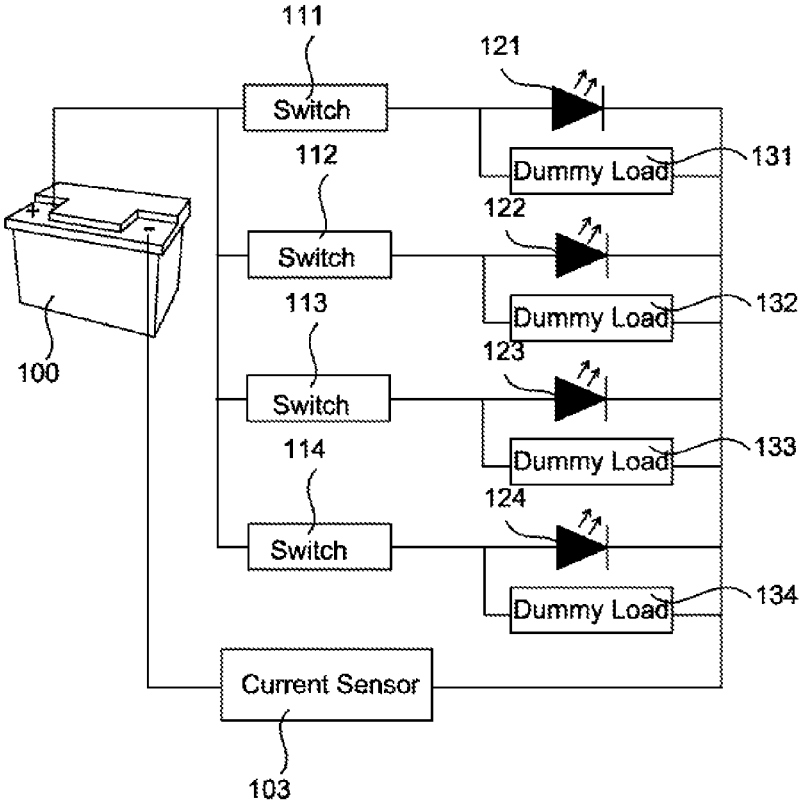
Fig.4 Prior Art
FIG. 4 illustrates yet another conventional circuit for a vehicle lamp.
Figure 5:
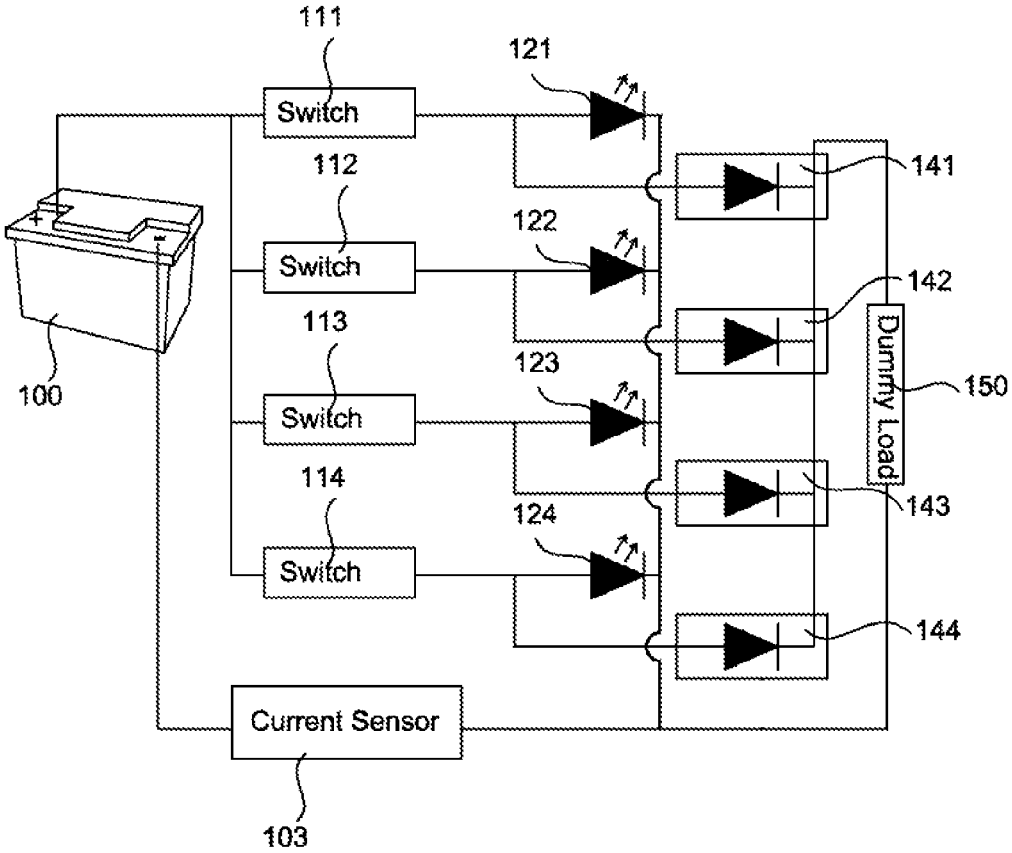
FIG. 5 illustrates a circuit for driving vehicle lamps according to one embodiment of the present invention.

FIG. 5 shows a circuit for driving vehicle lamps according to one embodiment of the present invention. A detailed structure in accordance with one embodiment of the present invention is illustrated in FIG. 5, wherein elements labeled the same as in FIG. 4 have similar functions.

In one embodiment, the dummy load 150 includes a resistor, each one of the switches 111, 112, 113, 114 includes a transistor, and the current sensor 103 includes a resistor.

As shown in FIG. 5, the circuit for driving the vehicle lamp comprises multiple unidirectional (one-way) conduction electronic components (141, 142, 143, 144). The unidirectional conduction electronic components (141, 142, 143, 144) are for example a diode (such as rectifier diode). The multiple unidirectional conduction electronic components are coupled to the dummy load 150, operable for conducting a current path to enable a current to flow through the dummy load 150 to decrease a total resistance of the circuit if the testing signal is detected.

In electronics, a diode is a two-terminal electronic component with asymmetric transfer characteristic, with low (ideally zero) resistance to current in one direction, and high (ideally infinite) resistance in the other. A semiconductor diode, the most common type today, is a crystalline piece of semiconductor material with a p-n junction connected to two electrical terminals. The most common function of a diode is to allow an electric charge to flow in one direction (called the diode's forward direction), while blocking such flow in the opposite direction (the reverse direction). Thus, the diode can be viewed as an electronic version of a check valve. This unidirectional behavior is called rectification, and is used to convert alternating current to direct current.

One terminal of the unidirectional conduction electronic components (141, 142, 143, 144) is electrically connected to between the switches (111, 112, 113, 114) and one terminal of the LED strings (121, 122, 123, 124) respectively. Another terminal of the unidirectional conduction electronic components (141, 142, 143, 144) is electrically connected to a common (identical) dummy load 150. Another terminal of the LED strings (121, 122, 123, 124) is coupled to the current sensor 103. The switches (111, 112, 113, 114) are connected to the combination of the LED strings (121, 122, 123, 124) and the diodes (141, 142, 143, 144) for switching, respectively. In this example, the whole circuit path includes four set combinations of the LED strings and the unidirectional conduction electronic components (141, 142, 143, 144), and a single dummy load 150. The current sensor 103 is coupled to the four set LED strings and the common dummy load 150.

As above-mentioned, the complete set of the vehicle lamps represent as multiple functions. In this embodiment, it needs to use the multiple combinations of the LED strings and the unidirectional conduction electronic components. But, just single dummy load is used such that the generating heat is reduced. Besides, the current sensor 103 is coupled to the multiple combinations of the LED strings and the unidirectional conduction electronic components.

The current through the LED string (121, 122, 123 or 124) will be created when one of the switches (111, 112, 113 or 114) is closed (or turned on) so as to complete the current path. In the present invention, by utilizing the unidirectional conduction electronic components (141, 142, 143, 144), such as diodes, the test load current is drawn to an identical dummy load 150. Regardless of which switch (111, 112, 113 or 114) is turned on, the through current will be rectified by the diode (141, 142, 143, 144). The overall currents flow through the dummy load 150, and then flow to the current sensor 103 such that the current sensor 103 senses the rated current. Therefore, the car's computer will be notified all bulbs are normal.

In one embodiment, a signal provides light output for automotive illumination control that includes a light emitting diode (LED) array. A power supply unit 100 provides independent power to each of the LED groups. Each LED group (121, 122, 123 or 124) corresponds to an input controlled switch (111, 112, 113 or 114) connected to a power line to provide power to the LED groups. A dummy load 150 draws power from the unidirectional conduction electronic components (141, 142, 143, 144), and a dummy load detection circuit monitors the dummy load 150 to insure that the power drawn by the dummy load 150 is greater than or equal to a predetermined threshold.

In operation, if the vehicle does not perform a self-testing, there is no testing signal applied on the power line. As a result, the switch is opened (turned off) and the current path is cut off.

The foregoing descriptions are preferred embodiments of the present invention. As is understood by a person skilled in the art, the aforementioned preferred embodiments of the present invention are illustrative of the present invention rather than limiting the present invention. The present invention is intended to cover various modifications and similar arrangements included within the spirit and scope of the appended claims, the scope of which should be accorded the broadest interpretation so as to encompass all such modifications and similar structures.

What is claimed is:

1. A circuit for driving a vehicle lamp, comprising:

a dummy load; and multiple unidirectional conduction electronic components coupled to said dummy load, to enable overall currents of said multiple unidirectional conduction electronic components to flow through said dummy load for decreasing a total resistance of said, circuit; and multiple LED strings, wherein each of said multiple LED strings being powered by a direct current power is coupled to each of said multiple unidirectional conduction electronic components, respectively.

2. The circuit of claim 1, wherein each of said multiple unidirectional conduction electronic components is a diode.

3. The circuit of claim 1, further comprising a current sensor coupled to said dummy load for enabling said overall currents of said multiple unidirectional conduction electronic components to flow through said current sensor.

4. The circuit of claim 3, wherein one terminal of each of said multiple LED strings is coupled to said current sensor.

5. The circuit of claim 4, wherein each of said multiple unidirectional conduction electronic component is a diode.

6. The circuit of claim 3, further comprising multiple switches, wherein each of said multiple switches is coupled to each of said multiple LED strings respectively, and coupled to one terminal of each of said multiple unidirectional conduction electronic components respectively.

7. The circuit of claim 6, wherein another terminal of each of said multiple unidirectional conduction electronic components is coupled to said dummy load.

8. The circuit of claim 7, wherein each of said multiple unidirectional conduction electronic component is a diode.

9. The circuit of claim 1, further comprising multiple switches, wherein each of said multiple switches is coupled to each of said multiple LED strings respectively, and coupled to one terminal of each of said multiple unidirectional conduction electronic components respectively.

10. The circuit of claim 9, wherein another terminal of each of said multiple unidirectional conduction electronic components is coupled to said dummy load.

11. The circuit of claim 10, wherein each of said multiple unidirectional conduction electronic component is a diode.

* * * * *